United States Patent [19]

Siegel et al.

[11] Patent Number: 4,473,226

[45] Date of Patent: Sep. 25, 1984

[54] ELECTRIC RATCHET

[75] Inventors: Nathan Siegel, Baltimore; Douglas A. Browning, Sykesville, both of Md.

[73] Assignee: Baltimore Therapeutic Equipment Company, Baltimore, Md.

[21] Appl. No.: 393,262

[22] Filed: Jun. 29, 1982

[51] Int. Cl.[3] ..... A63B 23/00

[52] U.S. Cl. ..... 272/132; 318/159; 188/161

[58] Field of Search ..... 318/159, 160, 436; 272/129, 132, 131; 434/62, 219, 260; 188/161

[56] References Cited

U.S. PATENT DOCUMENTS

| | | | |
|---|---|---|---|
| 2,777,439 | 1/1957 | Tuttle | 128/25 R |
| 2,864,048 | 12/1958 | Newell | 318/159 |
| 3,495,824 | 2/1970 | Cuinier | 272/67 |
| 3,848,467 | 11/1974 | Flavell | 272/116 |
| 4,059,790 | 11/1977 | Kennel | 318/436 |

*Primary Examiner*—Richard C. Pinkham
*Assistant Examiner*—Leo P. Picard
*Attorney, Agent, or Firm*—James J. Brown

[57] ABSTRACT

An electronic ratchet for allowing the application of mechanical resistance to an output shaft in one direction while ratcheting in the opposite direction, which comprises, in combination:

(a) an electromagnetically controlled friction brake coupled to an output shaft;

(b) provision for controlling the application of DC voltage across the electromagnet, regardless of the direction of rotation;

(c) a switch for selectively applying such voltage to obtain resistance to clockwise, counter clockwise, or both directions of rotation;

(d) an incremental shaft encoder coupled to the output shaft for determining the direction of shaft rotation;

(e) a decoder for decoding the direction of shaft rotation; and (f) an armature through which the output shaft is inserted, the shaft and armature being held as a single rotating unit by opposing keys on the output shaft and the keyways being characterized by a degree of free play equal to the sensitivity of the shaft encoder, whereby the direction of shaft revolution can be determined and compared to the switch setting during such free play.

7 Claims, 8 Drawing Figures

ELECTRIC RATCHET

TECHNICAL FIELD OF THE INVENTION

This invention relates to an electronic ratchet. More particularly, this invention relates to an electronic ratchet which is useful with constant torque braking devices, especially in therapeutic, diagnostic, or exercise devices, which permits ratcheting for either clockwise, counterclockwise, or neither direction of rotation.

BACKGROUND ART

Copending, commonly assigned U.S. Patent Application Ser. No. 6/099,838 filed Dec. 3, 1979 by John Engalitcheff, Jr. and now U.S. Pat. No. 4,337,050, the contents of which are incorporated by reference herein, describes a Method and Apparatus for the Rehabilitation of Damaged Limbs in which a plurality of interchangeable tool simulator accessories are detachably connected to a brake means having a constant, predetermined torque resistance for use in diagnostic and rehabilitation therapy of damaged upper extremeties. By simulating the natural movements of common activities under conditions of controlled torque resistance which remains linear rather than increasing with increased load, this device permits a gradual series of progressive exercises which can avoid muscle damage caused by trying to progress too quickly.

The device described therein employs a mechanical cam affixed to the rotating brake shaft which trips a microswitch to record the number of revolutions so as to enable the therapist to monitor the degree of exercise at each session. It has been found difficult to quantify such a registration technique and to distinguish between revolutions against applied torque resistance versus free-wheeling revolutions, which distinction is a valuable one for the therapist.

DISCLOSURE OF THE INVENTION

Accordingly, it is a general object of the present invention to provide an electronic ratchet suitable for accurately anticipating and controlling the force applied to a rotating shaft with respect to direction of rotation.

A further object of the present invention is to provide an electronic ratchet which permits determination of the direction of rotation prior to counting the degrees of rotation.

An additional object of the present invention is to provide an electronic ratchet having a decoding circuit for routing incoming pulses to a clockwise or counterclockwise counter.

A more particular object of the present invention is to provide an electronic ratchet suitable for use in rehabilitation therapy devices which permits accurate control and monitoring of the work expended by a patient.

Upon study of the specification and appended claims, further objects, features and advantages of the present invention will become more fully apparent to those skilled in the art to which this invention pertains.

DESCRIPTION OF THE INVENTION

Brief Description of the Drawings

The above and other objects, features, and advantages of the present invention will become more fully apparent from the following description, taken in conjunction with the annexed drawings, wherein.

BEST MODE FOR CARRYING OUT THE INVENTION

The electronic ratchet described herein is a device which allows the application of force to an output shaft in one direction of rotation while ratcheting in the opposite. The ratchet may also be disabled, thus allowing force to be applied in both directions.

The force device in this case is an electromagnetically controlled friction brake which is coupled to an output shaft.

When a DC voltage is impressed across the electromagnet, a resistance to rotation is applied to the output shaft. When the voltage across the magnet is removed, the shaft spins freely.

Figure 1:
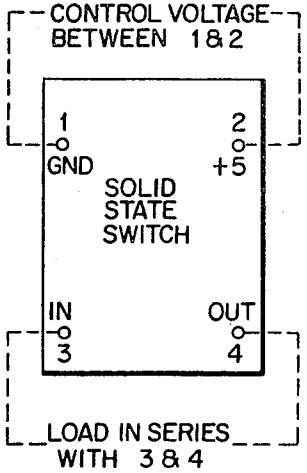
FIG. 1 is a schematic diagram of a solid state switch presently preferred for controlling voltage applied to an electromagnet in the device of the present invention.

The device controlling the voltage to the magnet is a solid state switch (SSS). This is a 4-pin encapsulated device manufactured by Grayhill (part #70YY14167). It may be thought of as a SPST relay, with the load in series with 3 and 4, and the control voltage applied across 1 and 2 (see FIG. 1).

Here it can be seen that if 5 volts is applied across pins 1 and 2, resistance will be felt at the shaft. If the 5 volts is removed, the shaft will spin freely.

Figure 2:
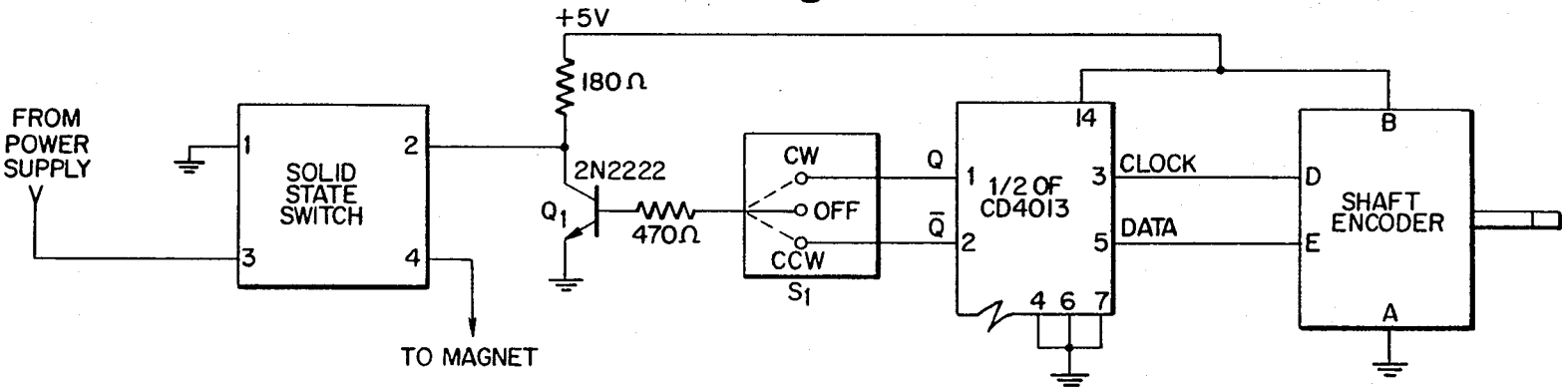
FIG. 2 schematically describes the ratchet circuit described herein.

The ratchet circuit can be used in 3 modes by setting the SPDT-center off rocker switch ($S_1$—FIG. 2).

Mode 1: Switch in center: no ratchet action; resistance to both clockwise (CW) and counter clockwise (CCW) rotation.

Mode 2: Switch closed toward counter clockwise (Figure B): resistance in counter clockwise direction; ratchet in clockwise direction.

Mode 3: Switch closed toward clockwise (Figure B): resistance in counter clockwise direction; ratchet in counter clockwise direction.

In Mode 1, the switch is open thus turning off $Q_1$, and allowing 5 v to appear at pin 2 of the SSS. This then applies magnet voltage, regardless of direction of rotation.

If the switch is depressed in either direction (clockwise or counter clockwise), the switch setting is compared to the direction of rotation and the result is used to either turn on the magnet voltage or shut it off (ratchet).

Figure 3:
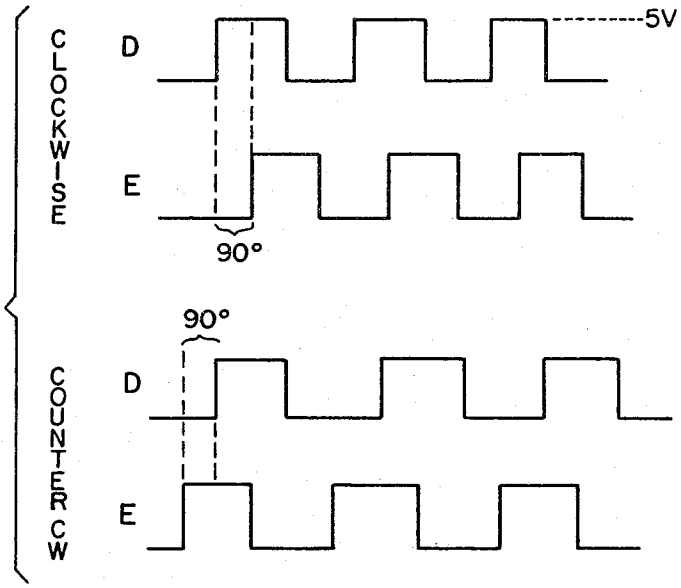
FIG. 3 illustrates the phase relationship between pulses which is used to determine the direction of rotation.

The means by which shaft direction is determined is via a shaft encoder such as the "ACCU-CODER" incremental shaft encoder model 716, manufactured by Encoder Products Company, Sandpoint, Id. which is coupled to the output shaft. This shaft encoder, when powered with 5 v between pins B and A will output a 5 v pulse for each ½ degree of shaft rotation from both pins D and E of FIG. 2, with respect to the common pin A. By observing the phase relationship between the pulses out of "D" and those out of "E", the direction of rotation can be determined. When the output shaft is turned in the clockwise direction, the "D" pulse leads the "E" pulse by 90 degrees. In the counter clockwise direction, "E" pulse leads "D" (FIG. 3).

The mechanical resistance is coupled to the output shaft by an armature which rides on the friction surface, and through which the output shaft is inserted. The shaft and armature are held as a single rotating unit by two keys on the output shaft placed 180 degrees apart.

For proper operation of the ratchet, it is essential that the keyways be modified so that there is precisely ½ degree of play in the keyways. This allows the shaft to be turned ½ degree in either direction before resistance is felt (because of the added ½ degree of free play, it takes ½ degree before the shaft engages the resistance bound armature). It is during this ½ degree that shaft direction is determined and compared to the switch setting for the appropriate setting of the SSS.

The device which actually compares the direction of rotation against the switch setting and sets the SSS is preferably an integrated circuit of the dual "D" type (CD 4013B).

Figure 4:
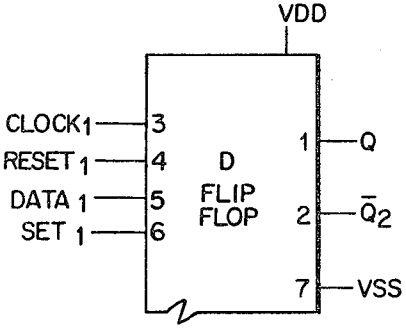
FIG. 4 schematically shows one of a pair of independent type "D" flip-flops which compare the direction of rotation against the switch setting and set the switch in response thereto.

As the name implies, it consists of two independent type "D" flip-flops (see FIG. 4). With the appropriate pins tied to common as per schematic, the circuit functions in the following manner. The logic level present at the data pin (5) is transferred to the "Q" pin (1) during a positive going transition on the clock pin (3). Once the clock pin is either hi or lo, no further transfer is initiated (Figure E). The "Q" pin is thusly "latched" and open for a change only during a positive transition on the clock pin. The $\overline{Q}$ pin (2) is present at the opposite level of Q (1), i.e., if Q (1) is hi, $\overline{Q}$ (2) is low.

Figure 6:
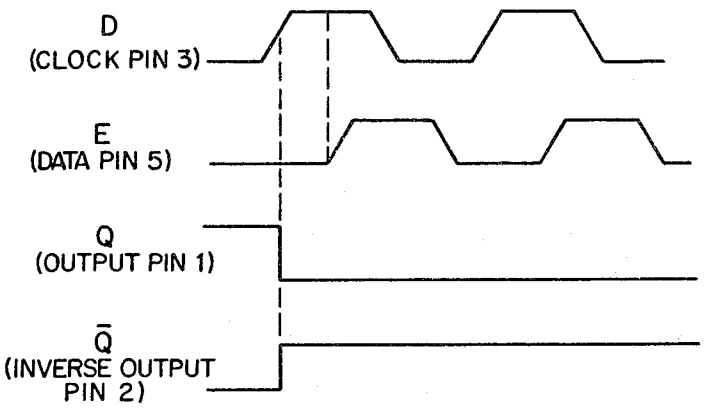
FIG. 6 shows the states of Q and $\overline{Q}$ when rotation is in the clockwise direction.
Figure 5:
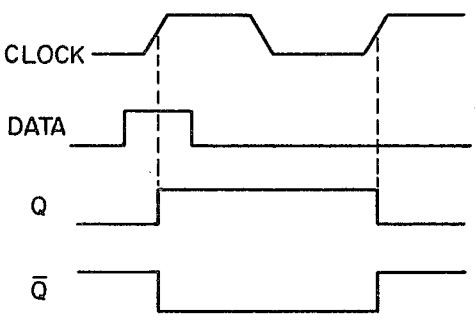
FIG. 5 shows how the Q pin is latched and open for change only during a positive transition on the clock pin, as well as the relationship between the Q pin and the $\overline{Q}$ pin.

Having now defined the magnet controlling device (the SSS), the shaft direction encoder (the ACCU-Coder), and the direction de-coder (the CD 4013), the entire circuit can be understood. The following discussion assumes the switch is depressed for resistance in the clockwise direction and ratcheting in the counter clockwise direction, and that the initial direction of rotation of the shaft is clockwise. In the clockwise direction, "D" leads "E" (FIG. 6). This means that every time a positive going transition appears at the clock pin ("D"), the Data Pin ("E") is lo. This keeps the Q pin in lo, and the $\overline{Q}$ pin hi as long as rotation continues in the clockwise direction. Referring to $S_1$, it is depressed such that Q is tied to the base of a transistor. (When this transistor is turned on +5 v on the base, the SSS turns off. When the transistor base is grounded, the transistor turns off, and the SSS turns on.) In such a situation, with clockwise rotation, and Q being lo (ground) and tied to the base, the SSS is turned on, and voltage is applied to the magnet resulting in resistance at the output shaft.

When the shaft is turned counter clockwise ($S_1$ unchanged), Q now becomes hi (+5 v) turning on the transistor, turning off the SSS, and interrupting the voltage applied to the magnet, allowing the output shaft to rachet without resistance. The operation of the circuit for resistance in the counter clockwise direction is the same.

Figure 8:
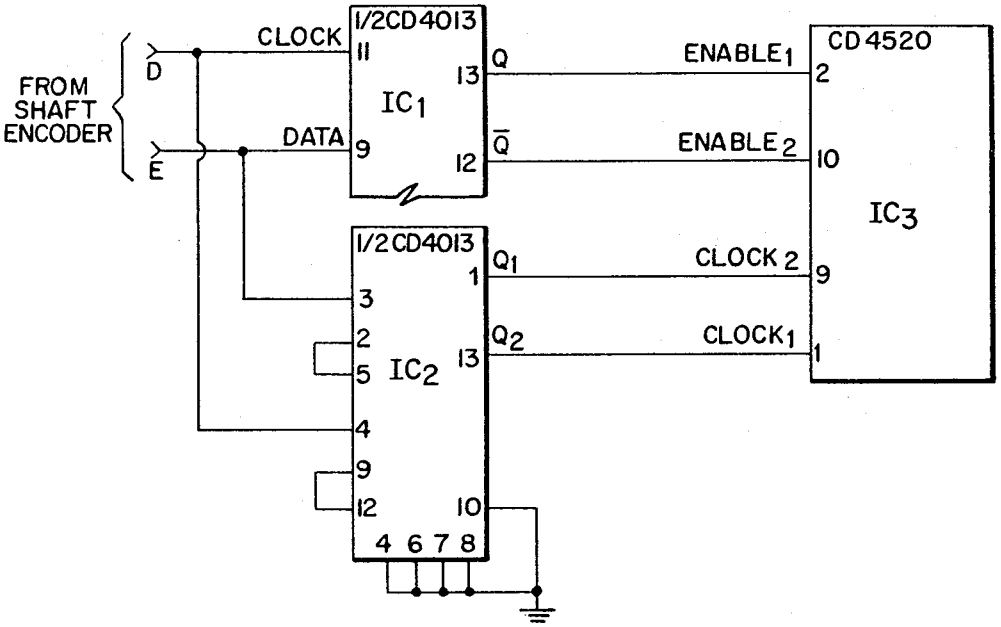
FIG. 8 schematically illustrates the decoding counter circuit.
Figure 7:
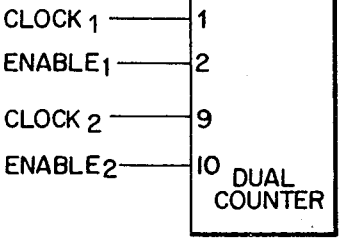
FIG. 7 illustrates a simplified pinout of a dual counting chip.

A decoding counter circuit decodes incoming pulses into clockwise or counter clockwise and routes them to the appropriate of two counters. It is necessary during clockwise rotation to route the pulses into the clockwise degree counter, while inhibiting counting in the counter clockwise counter. The opposite is true for counter clockwise rotation. Involved in this scheme are two type "D" flip-flops and one dual counter (CD 4520). The CD 4520 is actually 2 counters on one chip. When the "enable" pin is hi, a count is registered on a positive going transition of the "clock" pin. The circuit schematic is shown in FIG. 8.

$IC_3$ is the counting unit. Since the shaft encoder puts out pulses every ½ degree, its output must be divided by two to give the true number of degrees of rotation. This is the function of $IC_2$. $IC_1$ is set up to inhibit the appropriate counter while allowing counts on the right counter.

In the clockwise direction, "D" always leads "E", which holds Q lo, and $\overline{Q}$ hi on $IC_1$. Since counts can only occur when "enable" is hi, this effectively inhibits the counter clockwise counter during clockwise rotation. The same is true for counter clockwise rotation.

Without further elaboration, it is believed that one skilled in the art can, using the preceding description, utilize the present invention to its fullest extent. The following preferred specific embodiments are, therefore, to be construed as merely illustrative and not limitative of the remainder of the disclosure in any way whatsoever.

From the foregoing description, one skilled in the art to which this invention pertains can easily ascertain the essential characteristics thereof and, without departing from the spirit and scope of the present invention, can make various changes and modifications to adapt it to various usages and conditions.

INDUSTRIAL APPLICABILITY

As can be seen from the present specification and examples, the present invention is industrially useful in providing an electronic ratchet which can be used for controlling and quantitatively recording the amount of work expended by a patient undergoing rehabilitation therapy with the aid of a torque resistant work simulator.

What is claimed is:

1. An electronic ratchet for allowing the application of mechanical resistance to an output shaft in one direction while ratcheting in the opposite direction, which comprises, in combination:

(a) an electromagnetically controlled friction brake coupled to an output shaft;

(b) means for controlling the application of DC voltage across the electromagnet, regardless of the direction of rotation;

(c) switching means for selectively applying such voltage to obtain resistance to clockwise, counter clockwise, or both directions of rotation;

(d) an incremental shaft encoder coupled to the output shaft for determining the direction of shaft rotation;

(e) means for decoding the direction of shaft rotation; and (f) an armature through which the output shaft is inserted, the shaft and armature being held as a single rotating unit by opposing keys on the output shaft and the keyways being characterized by a degree of free play equal to the sensitivity of the shaft encoder, whereby the direction of shaft revolution can be determined and compared to the switch setting during such free play.

2. An electronic ratchet according to claim 1, wherein the means for controlling the application of said DC voltage is a solid state switch.

3. An electronic ratchet according to claim 1, wherein the switching means for selectively applying said voltage is an SPDT-center off rocker switch.

4. An electronic ratchet according to claim 1, wherein the shaft encoder generates two pulses 90 degrees out of phase for characterizing the direction of rotation.

5. An electronic ratchet according to claim 4, wherein the means for decoding the direction of rotation, comparing it against the selector switch setting, and resetting said solid state switch is a pair of independent type "D" flip-flops.

6. An electronic ratchet according to claim 5, further comprising a circuit for decoding incoming pulses into clockwise or counter clockwise counts and accumulating said pulses on an appropriate counter for clockwise or counterclockwise revolutions.

7. An electronic ratchet according to claim 6, wherein said circuit includes two type "D" flip-flops and one dual counter.

* * * * *